United States Patent [19]

Chao

[11] Patent Number: 4,844,639

[45] Date of Patent: Jul. 4, 1989

[54] PUSH-TYPE WRITING INSTRUMENT

[76] Inventor: Wen-Kwei Chao, No. 47, Chung-Cheng 1-St Road, Ying-Ko, Taipei, Taiwan

[21] Appl. No.: 110,781

[22] Filed: Oct. 21, 1987

[51] Int. Cl.[4] ..... B43K 21/16; B43K 21/22

[52] U.S. Cl. ..... 401/65; 401/94

[58] Field of Search ..... 401/93, 94, 67, 65

[56] References Cited

U.S. PATENT DOCUMENTS

| | | | |
|---|---|---|---|
| 253,803 | 2/1882 | Wittmann | 401/67 |
| 381,612 | 4/1888 | Bussler | 401/67 |
| 2,046,836 | 7/1936 | Neary | 401/67 |
| 2,358,091 | 9/1944 | Lovejoy | 401/67 X |
| 2,427,648 | 9/1947 | Farrington | 401/65 |
| 2,509,849 | 5/1950 | Von Allmen | 120/17 |
| 2,563,551 | 8/1951 | Refsdal | 401/65 |
| 3,922,098 | 11/1975 | Katz | 401/94 |

FOREIGN PATENT DOCUMENTS

| | | | |
|---|---|---|---|
| 159819 | 6/1940 | Fed. Rep. of Germany | 401/65 |
| 809391 | 5/1951 | Fed. Rep. of Germany | 401/67 |
| 885368 | 8/1953 | Fed. Rep. of Germany | 401/67 |
| 972637 | 8/1959 | Fed. Rep. of Germany | 401/67 |
| 772755 | 11/1934 | France | 401/65 |
| 926415 | 10/1947 | France | 401/65 |
| 967873 | 11/1950 | France | 401/94 |
| 1003136 | 3/1952 | France | 401/65 |
| 57628 | 3/1953 | France | 401/65 |
| 1089776 | 3/1955 | France | 401/94 |
| 399592 | 10/1933 | United Kingdom | 401/65 |

*Primary Examiner*—Steven A. Bratlie

*Attorney, Agent, or Firm*—Leonard Bloom

[57] ABSTRACT

A push-type writing instrument essentially comprising an outer body having a tapered forward portion in which lead is retained. The lead is retained by a pair of radially opposed fingers provided on the tapered forward portion for frictional engagement with a lead. A lead containing inner sleeve has a rearward section of a larger diameter and a forward section of a substantially smaller diameter. The forward section of the inner sleeve is formed with a tapered portion having a pair of longitudinal slots rendering the tapered portion a radially contractible nature thereby constituting a lead clamping means in a cooperative manner with a slidable tightening ring provided about the tapered portion. A spring is coiled about the forward section of the inner sleeve for urging the inner sleeve to retain the writing instrument in a normal writing position.

1 Claim, 3 Drawing Sheets

5
3
3"
3'
21
10
20
4
22
12
24
23
25
13
14
2

PUSH-TYPE WRITING INSTRUMENT

FIELD OF THE INVENTION

This invention relates to a push-type writing instrument, and is particularly concerned with a new and improved propelling pencil in which the lead or crayon is projected the requisite distance out of the front end of an outer tube, to permit writing, by pressing on the rear end of the pencil.

BACKGROUND OF THE INVENTION

Pencils which hold the lead by means of contractible chuck jaws have been well known and extensively used. The example of this type of clamp means was disclosed in U.S. Pat. No. 2,509,849. The clamp of this type is generally made of metal, such as copper or copper alloy and requires machinery of high precision which results in low production efficiency and consequently involves higher cost.

SUMMARY OF THE INVENTION

The present invention aims at provision of a simple, durable and yet an inexpensive pencil adapted for mass production with a considerably low cost, comprising a clamping means of a type completely different from the prior art, and formed totally with synthetic resin.

The present invention also aims at provision of a pencil whose lead can be protruded at a definite length in a step-by-step mode by pressing on the press means deployed at one end of the pencil.

In accordance with the present invention, there is provided a novel clamping means for grasping the lead in the writing position, and a lead retaining means which constantly and frictionally engages with the lead, preventing the lead from slipping out from the pencil body when the lead clamping means releases its grasping action. Furthermore, said lead retaining means cooperates with the clamping means to enhance the firmness of grasp of the lead to thereby ensure stable positioning of the lead during use of the writing instrument.

Other features and advantages of the invention will be apparent from the following description taken in connection with the drawings wherein like reference characters designate corresponding parts in the several views.

GENERAL DESCRIPTION OF THE PREFERRED EMBODIMENTS

Figure 1:
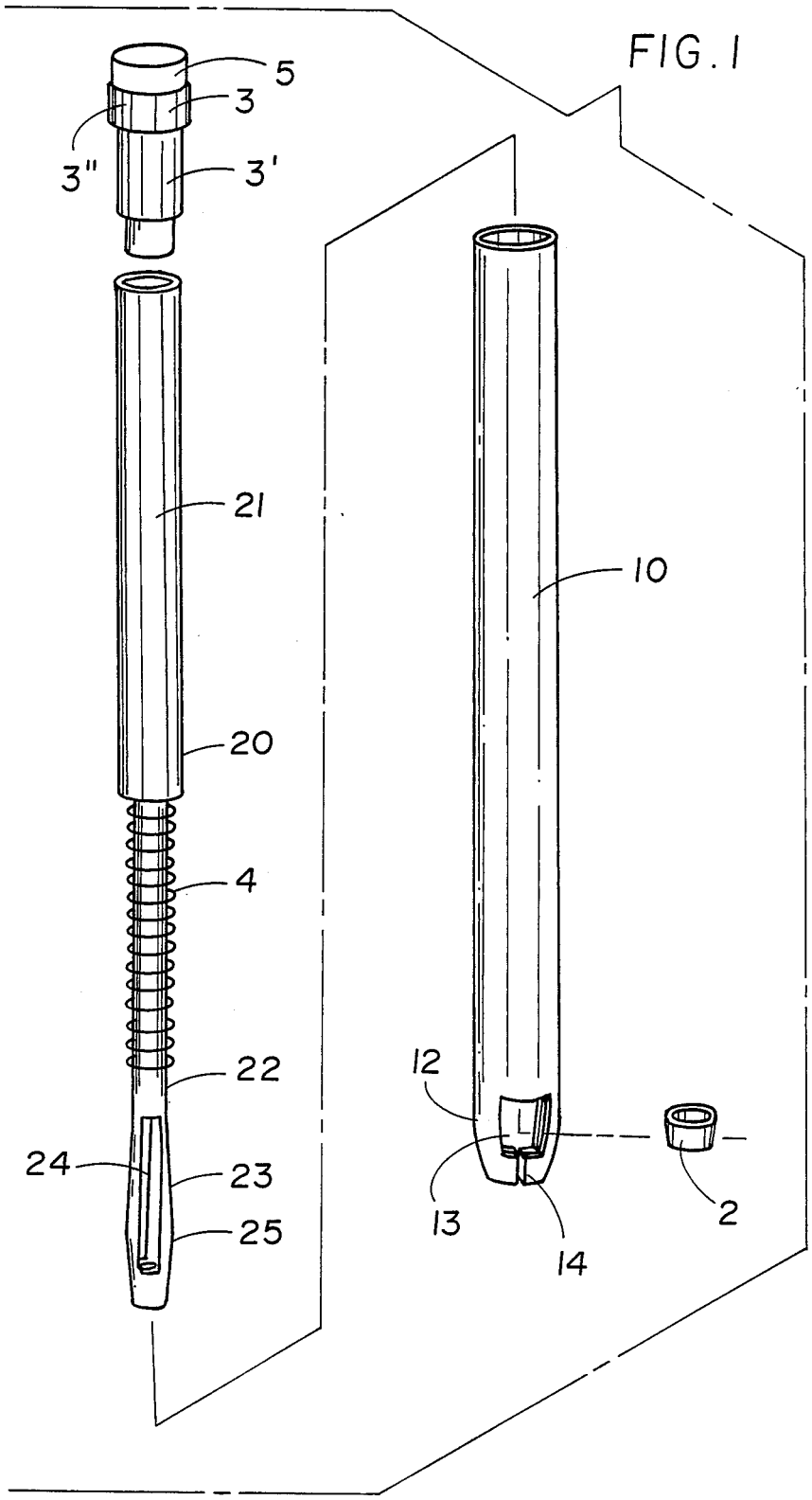
FIG. 1 is an exploded view in perspective of the pencil of the first embodiment of the present invention.

Referring now to the drawings, the outer tube 10 of the pencil having a cylindrical inner wall is formed with a protruded annular seat 11 and a tapered front (or forward) portion 12 which is provided with a window 13, a slit 14 and a lead 1 retaining means consisting of a pair of opposed fingers or detents 15,15. The slit 14 is formed at the frontmost portion of the tube 10 opening to the lower edge of the window 13 and front edge of the tube 10 to provide said portion with a contractility to thereby facilitate insertion of a tightening ring 2 from the window 13 to the inside of the tube 10 and provision of resiliency with the lead retaining means.

Figure 5:
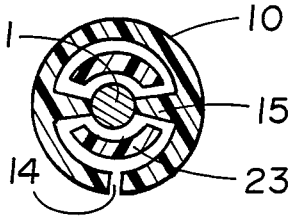
FIG. 5 shows a cross section taken on the line a—a′ of FIG. 3.
Figure 6:
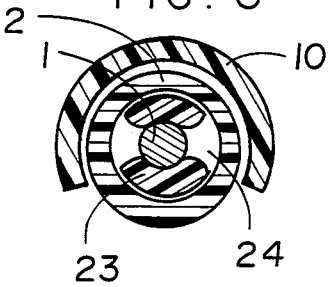
FIG. 6 shows a cross section taken on the line b—b′ of FIG. 3.
Figure 7:
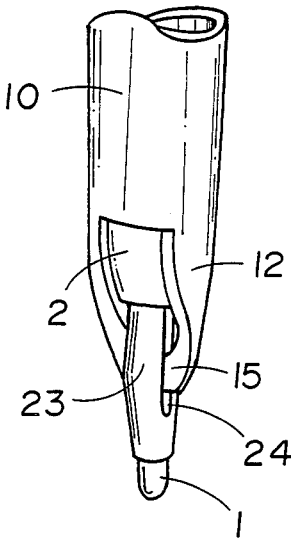
FIG. 7 is a perspective view of the front portion of the pencil of the second embodiment of the invention.

The fingers 15,15 forming the characteristics of the lead retaining means are diametrically and oppositely formed on the inner wall of the front portion of the tube 10 as most clearly shown in FIG. 5. The fingers 15,15 extend axially and are provided with a longitudinally arcuate groove at each protruded end thereof. In addition the length of the protruded ends of the fingers is so designed as to allow the fingers to frictionally engage with a lead or crayon, through the slots 24,24 as will be described hereinafter.

Figure 8:
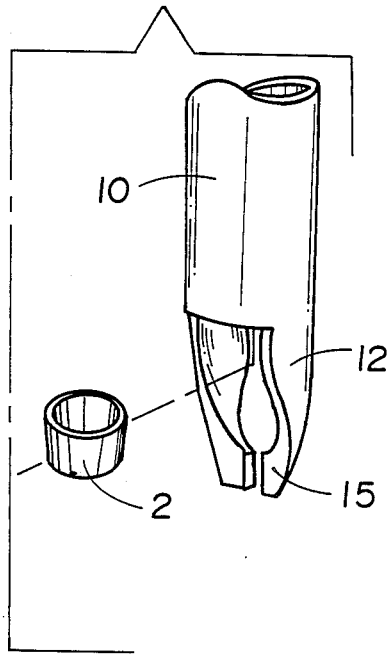
FIG. 8 is an exploded view of the pencil of FIG. 7 showing the construction of the outer tube of the pencil and the tightening ring forming a part of the clamp means of the invention.

The front portion of the outer tube 10 may also be formed as shown in FIG. 8 wherein the opposed side walls of the portion have been cut away, forming a pair of downwardly extending arms 12,12 each having a finger 15. This device functions as a lead retaining means in the same manner as does the above described embodiment.

Another component which forms an important feature of the present pencil is an inner tube (or sleeve) 20 illustrated in FIG. 1. As can be seen from the drawing, the inner tube 20 is composed of an upper or rearward section 21 of a larger diameter and a lower (or forward) section 22 of a substantially smaller diameter. The upper section 21 is provided with an axial hole (or inner diameter) adapted for storing a plurality of leads ready for use, while the hole (or inner diameter) provided in the lower section 22 allows just a single piece of lead to pass therethrough. An intermediate section 26 has a conical opening directing the lead between the upper section 21 and the lower section 22.

The front portion of the lower section 22 of the inner tube 20 is formed with a gently tapered portion (or diameter) 23, as best seen in FIG. 1. On the diametrically opposite side walls of the tapered portion 23, there are provided with longitudinal slots 24,24 rendering said portion a diametrically radially contractible nature and cooperatively constituting a clamping means with the aforesaid tightening ring 2. The tightening ring 2 is of a short cylindrical tube having a fairly good resiliency and preferably having a diameter slightly smaller than the outer diameter of the widest part of the tapered portion 25. Thus, the tightening ring 2 may be forcibly pushed from the front end of the tube and slidably located about the tapered portion 23. To the rear end of the inner tube, a press member (or end cap) 3 is secured between the lower end of the upper section 21 of the inner tube and the upper edge of the annular seat 11 formed on the inner wall of the outer tube 20, a spring 4 is provided about the lower section 22 of the inner tube 20 for urging the inner tube 20 to normally locate in its retracted position, i.e. writing position, as shown in FIG. 2 (A).

The body portion 3' of the press member 3 has an outer diameter slightly smaller than the inner diameter of the inner tube 20, and both are smaller than the inner diameter of the outer tube 10. The press member 3 may be provided with an eraser 5 and the like at its rear end as desired.

Figure 2:
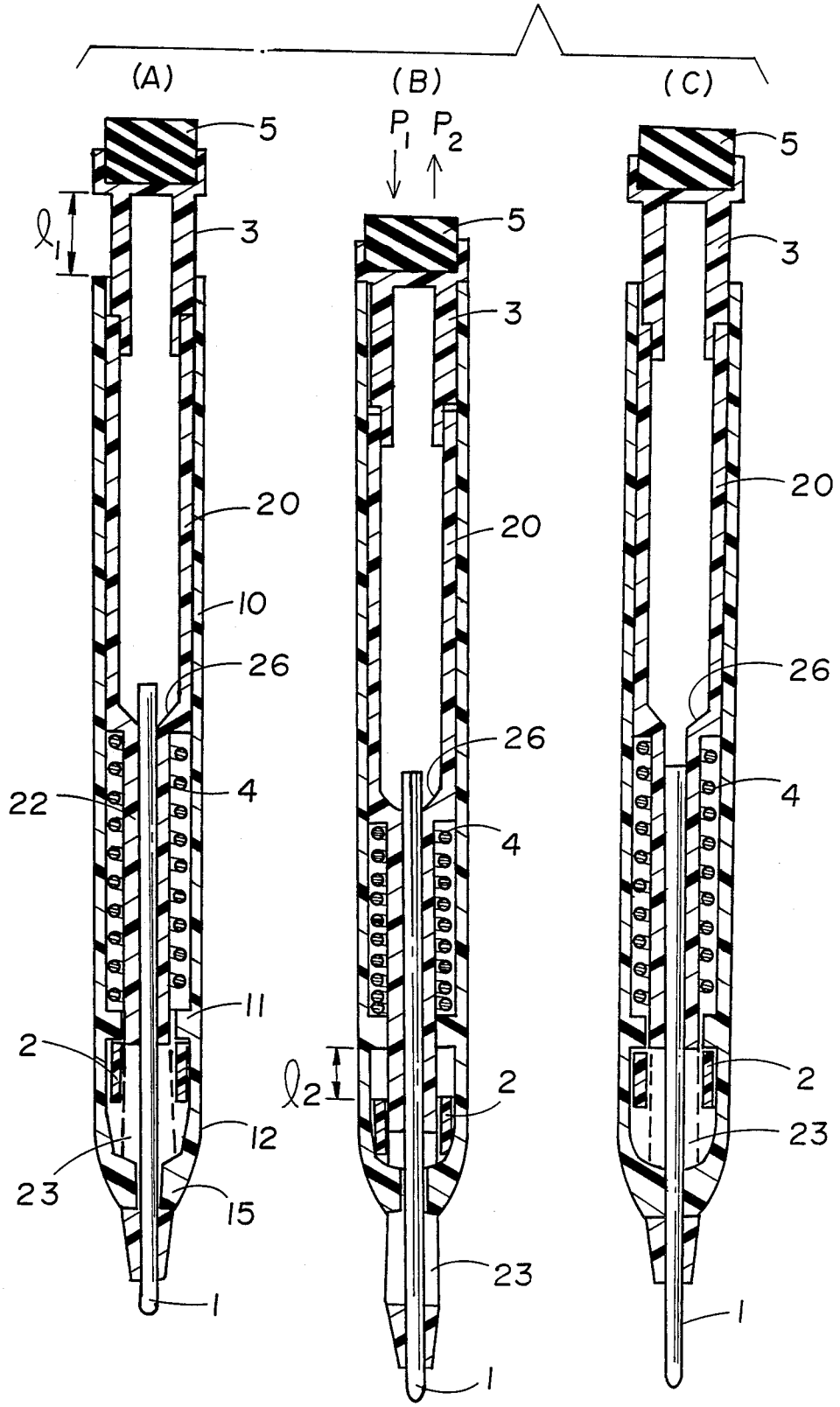
FIG. 2 illustrates the operation modes of the present pencil in longitudinal sectional view.
Figure 4:
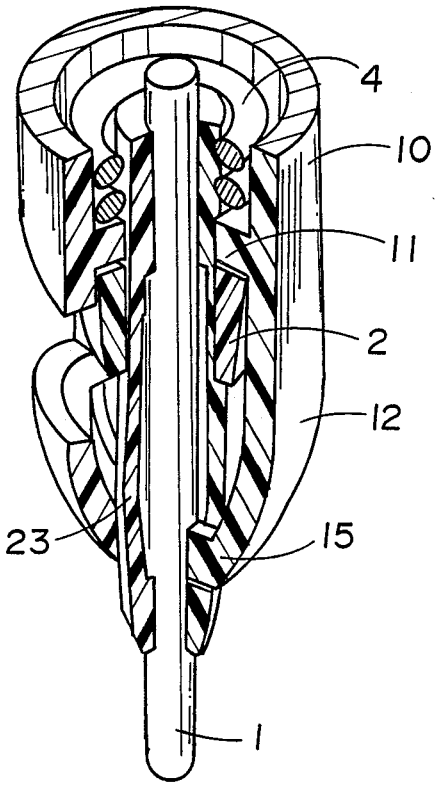
FIG. 4 shows a sectional view of the front portion of the present pencil.
Figure 3:
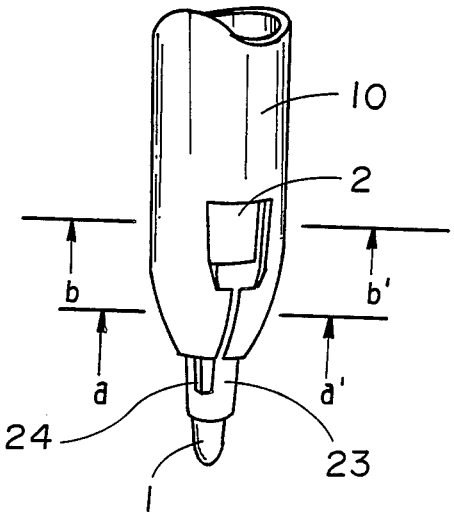
FIG. 3 is a perspective view showing the front portion of the present pencil.

FIG. 2 illustrates the structure as well as the operation modes of the present pencil, wherein (A) represents the pencil in its position ready for writing. In order to cause the lead 1 to advance, axial pressure is applied in the direction $P_1$ on the press member 3 against the action of the spring 4. The press member 3 moves the inner tube 20 along with the tightening ring 2 to bring the front edge of the ring 2 in contact with the rear edges of the fingers 15,15. Then press member 3 is further pushed until its collar 3" comes in contact with the rear end of the outer tube 10 as shown in (B). During this later stage of movement, the ring 2 is blocked by the fingers 15,15 and the inner tube alone progressively advances to a predetermined distance of $l_1-l_2$ [refer to FIG. 2 (A) and (B)].

The further advancement of the inner tube 20 brings the ring 2 to release its clamping of the tapered portion 23 of the inner tube 20 and as a consequence, the lead 1 assumes a free state. However, by virtue of the frictional engagement of the fingers 15,15 with the lead 1, the lead will not fall downward due to gravity.

When pressure on the press member 3 is released, the spring 4 effects the return movement of the inner tube 20 and the tightening ring 2 in the direction $P_2$. During the first part of this return movement, the rear edge of the ring 2 comes in contact with the front edge of the seat 11, while the lead 1 is held by the fingers 15,15 in the advanced position to which it has been moved by the action of the pressing of the press member 3.

In the second stage of the return of the movement, the effective tapered part 23 of the inner tube 20 is progressively clamped by the ring 2 and forces the tapered part 23 to effect a radial contraction to thereby securely hold the lead 1 in said advanced position.

The parts of the pencil are then again in the writing position shown in (C).

The propelling pencil hereinbefore described, although comprising a small number of components as compared with known pencils, functions very reliably. None of the components, which are of the simplest form, require precise machining. Furthermore, all components are made of synthetic resin and can be assembled easily, so that the pencil is inexpensive to manufacture.

Although the invention has been described in its preferred form with a certain degree of particularity, it is understood that various modification may be made therein, and it is intended that the appended claims shall cover all such modifications as fall within the true spirit and scope of the invention.

What is claimed is:

1. A push-type writing instrument comprising in combination:

an outer body comprising a sleeve having an open rearward portion and a tapered forward portion, the outer body further having an inner wall provided with an internal annular seat formed therein substantially adjacent to the forward portion of the body;

an inner sleeve having a forward section and a rearward section, each section having an outer diameter, the outer diameter of the forward section being reduced with respect to the outer diameter of the rearward section of the inner sleeve, such that the respective sections of the inner sleeve are joined by an intermediate section, the forward section of the inner sleeve further having an inner diameter in which a length of lead is slidably guided therein, the rearward section of the inner sleeve further has an inner diameter adapted for storing a plurality of leads, the intermediate section of the inner sleeve further having a conical opening communicating with the inner diameter of the forward section and the inner diameter of the rearward section of the inner sleeve, whereby individual pieces of lead may pass from the rearward section into the forward section, the rearward section of the inner sleeve further being slidably guided within the outer body;

a spring retained within the outer body axially between the internal annular seat thereof and the intermediate section of the inner sleeve, encircling a portion of the forward section of the inner sleeve, and thereby constantly urging the inner sleeve rearwardly of the body;

a cap means for closing the rearward open portion of the outer body and for engaging the rearward section of the inner sleeve, thereby facilitating a selective manually-actuated sliding movement of the inner sleeve and the lead carried thereby within the outer body;

the inner wall of the outer body at the tapered forward portion thereof having a pair of radially opposed, axially extended fingers for frictional engagement with the lead, the fingers further having longitudinally arcuate grooves in which the lead is retained;

the forward section of the inner sleeve having a forwardmost portion formed with a tapering diameter and provided with two opposed longitudinal slots, thereby rendering the forwardmost portion of the forward section of the inner sleeve radially contractable, the radially opposed, axially extended fingers on the tapered forward portion of the inner wall of the outer body extending through the opposed longitudinal slots on the forwardmost portion of the inner sleeve thereby engaging the lead, the fingers further engaging the inner sleeve thereby stopping the urging rearwardly by the spring such that the inner sleeve is retained within the outer body;

a resilient tightening ring retained within the tapered forward portion of the outer body, the resilient ring having an inner diameter, the inner diameter being reduced with respect to the tapering diameter of the forwardmost portion of the forward section of the inner sleeve, and the resilient ring being slidably guided over the tapering diameter thereby cooperating with the forwardmost radially contractable position of the inner sleeve to clamp the lead therein;

the tapered forward portion of the outer body having a forwardmost end and further having a slit formed therein extending axially from the forwardmost end thereof, the forward portion of the body further having a window formed therein rearwardly of the slit and communicating with the slit whereby the slit provides a contractility to the forwardmost end of the outer body and facilitates the insertion of the resilient tightening ring through the window whereby the resilient ring may be disposed within the outer body and whereby the inner sleeve may be slidably inserted through the open rearward portion of the outer body and axially within the body such that the forwardmost portion of the inner sleeve formed with a tapering diameter is received and retained within the resilient ring; and the outer body, the inner sleeve, the tightening ring and the end cap being made of synthetic resin.

* * * * *